US008960452B2

(12) United States Patent
Rhodes, II et al.

(10) Patent No.: US 8,960,452 B2
(45) Date of Patent: Feb. 24, 2015

(54) DRYING RACK ASSEMBLY

(71) Applicant: Handi-Craft Company, St. Louis, MO (US)

(72) Inventors: Idus L. Rhodes, II, Maplewood, MO (US); Janine Berger, Hoboken, NJ (US)

(73) Assignee: Handi-Craft Company, St. Louis, MO (US)

( * ) Notice: Subject to any disclaimer, the term of this patent is extended or adjusted under 35 U.S.C. 154(b) by 0 days.

(21) Appl. No.: 14/102,845

(22) Filed: Dec. 11, 2013

(65) Prior Publication Data

US 2014/0166599 A1 Jun. 19, 2014

Related U.S. Application Data

(60) Provisional application No. 61/735,639, filed on Dec. 11, 2012.

(51) Int. Cl.
*A47G 19/08* (2006.01)
*A47L 19/04* (2006.01)

(52) U.S. Cl.
CPC ..... *A47L 19/04* (2013.01)
USPC ..... 211/41.6; 220/572

(58) Field of Classification Search
CPC ..... A47L 19/00; A47L 19/02; A47L 19/04; A47L 15/501; A47J 47/20
USPC ..... 211/13.1, 41.1, 41.2, 41.3, 41.4, 41.5, 211/41.6, 41.7, 41.8, 41.9, 41.11, 41.14, 211/41.18, 85.25, 132.1; 220/571, 572; 34/104; 4/656, 657
See application file for complete search history.

(56) References Cited

U.S. PATENT DOCUMENTS

| | | | | | |
|---|---|---|---|---|---|
| 2,443,404 | A | * | 6/1948 | Tallarico | 211/41.4 |
| 2,479,118 | A | * | 8/1949 | Jenness | 211/41.5 |
| 2,516,088 | A | * | 7/1950 | Einhorn | 211/41.5 |
| 3,752,322 | A | * | 8/1973 | Fiocca et al. | 211/41.8 |
| 3,952,875 | A | * | 4/1976 | Lombardo | 211/41.6 |
| 4,169,638 | A | * | 10/1979 | Cirasuolo et al. | 312/229 |
| 4,854,537 | A | * | 8/1989 | Welch | 248/346.5 |
| D353,921 | S | * | 12/1994 | Lippisch et al. | D32/55 |
| 5,385,261 | A | * | 1/1995 | Lippisch et al. | 220/572 |
| 6,038,784 | A | | 3/2000 | Dunn et al. | |
| 6,125,548 | A | * | 10/2000 | Dunn et al. | 34/104 |
| 7,207,074 | B1 | * | 4/2007 | Stewart | 4/637 |
| 7,344,036 | B2 | * | 3/2008 | Jerstroem et al. | 211/41.6 |
| 7,458,470 | B2 | * | 12/2008 | Jerstroem et al. | 211/41.4 |
| RE43,349 | E | * | 5/2012 | Dunn et al. | 34/104 |
| 2001/0040141 | A1 | * | 11/2001 | Martorella et al. | 211/41.6 |

(Continued)

OTHER PUBLICATIONS

International Search Report and Written Opinion for PCT/US2013/074265, dated Apr. 16, 2014.

*Primary Examiner* — Joshua Rodden
(74) *Attorney, Agent, or Firm* — Armstrong Teasdale LLP

(57) ABSTRACT

A drying rack assembly for countertop placement has a drip pan and a drying rack positionable on the drip pan for holding one or more objects to be dried above the drip pan. The drying rack includes a base seatable on the drip pan, with at least a portion of the base being configured for disposition above the drip pan upon seating the drying rack on the drip pan. At least one panel is pivotably connected to the base for positioning relative to the base between a standing position for supporting the one or more objects to be dried and a collapsed position in which the at least one panel is generally laid down against the base.

18 Claims, 18 Drawing Sheets

(56) References Cited

U.S. PATENT DOCUMENTS

2007/0151937 A1 7/2007 Gillisie
2007/0272632 A1* 11/2007 Jerstroem et al. ..... 211/41.4
2008/0149644 A1* 6/2008 Piacenza et al. ..... 220/572
2009/0211994 A1* 8/2009 Yang et al. ..... 211/41.4
2010/0065517 A1 3/2010 Lam

* cited by examiner

DRYING RACK ASSEMBLY

CROSS REFERENCE TO RELATED APPLICATION

This application claims the benefit of U.S. Provisional Application No. 61/735,639 filed Dec. 11, 2012, which is incorporated herein by reference.

BACKGROUND

The present invention relates generally to drying racks, and more particularly, to a drying rack selectively configurable between a folded position for storage and an upright position for retaining objects to be dried.

SUMMARY

In one embodiment, a drying rack assembly for countertop placement and configured to hold one or more objects to be dried generally comprises a drip pan and a drying rack positionable on the drip pan for holding the one or more objects to be dried above the drip pan. The drying rack generally comprises a base seatable on the drip pan, with at least a portion of the base being configured for disposition above the drip pan upon seating the drying rack on the drip pan. At least one panel is pivotably connected to the base for positioning relative to the base between a standing position for supporting the one or more objects to be dried and a collapsed position in which the at least one panel is generally laid down against the base.

In another embodiment, a drying rack assembly for countertop placement and configured to hold one or more objects to be dried generally comprises a base having a front end and a rear end, with the base being arched along at least a portion thereof intermediate the front end and rear end to define a first portion disposed at a first height and a second portion disposed at a second height greater than the first height. A first panel is pivotably connected to the base at the first portion for positioning relative to the base between a standing position for supporting the one or more objects to be dried and a collapsed position in which the first panel is generally laid down against the base. A second panel is connected to the base at the second portion for positioning relative to the base between a standing position for supporting the one or more objects to be dried and a collapsed position in which the second panel is generally laid down against the base.

BRIEF DESCRIPTION OF THE DRAWINGS

Corresponding reference characters indicate corresponding parts throughout the several views of the drawings.

DETAILED DESCRIPTION OF THE DRAWINGS

Figure 1:
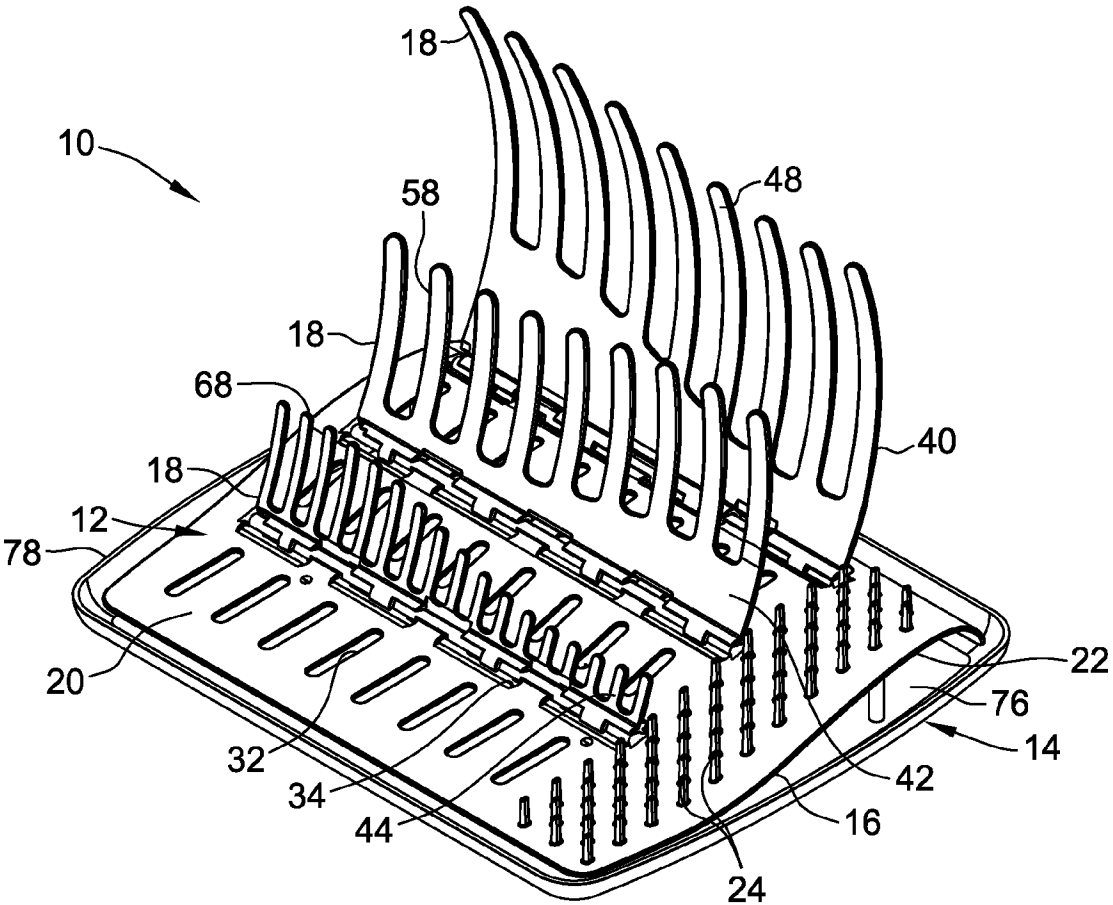
FIG. 1 is a perspective view of one embodiment of a drying rack assembly according to the present disclosure.

Referring now to the drawings, and in particular to FIG. 1, one suitable embodiment of a drying rack assembly for use in drying baby bottles (or any other suitable object(s)) while sitting on a surface such as a countertop is generally indicated at 10. The drying rack assembly 10 comprises a porous drying rack, generally indicated at 12, for supporting the various components of the baby bottles while allowing liquid (e.g., water) that drains off the various bottle components or other objects being dried to pass through the drying rack, and a drip pan, generally indicated at 14, for collecting liquid that passes through the drying rack. While the drying rack assembly 10 is described herein for use in drying baby bottles, it is understood that the drying rack assembly can be used to dry any other items including, but not limited to, cups, glasses, bottles, pitchers, dishes, eating utensils, serving utensils, food preparation equipment, and/or cooking equipment. It is contemplated that the drying rack 12 can be used without the drip pan 14. That is, in some suitable embodiments, the drip pan 14 can be omitted.

As described in more detail below, the illustrated drying rack 12 (and thus broadly, the drying rack assembly 10) is selectively manually configurable between a folded position (FIG. 7), a first partially folded position (FIG. 6), a second partially folded position (FIG. 5) and an upright position (FIGS. 1-5). In the folded position of the drying rack 12, which is seen best in FIG. 7, the drying rack assembly can be conveniently stored and transported by the consumer. In addition, the folded position of the drying rack 12 facilitates packaging, shipping, storage, and displaying of the drying rack assembly 10 by both the manufacturer and the retailer.

The drying rack assembly 10 can be used to dry baby bottles or any other suitable objects in any of the various drying rack 12 positions shown in FIGS. 1-6. More specifically, the drying rack assembly 10 can be used in the first partially folded position, the second partially folded position, and the upright position. Thus, the consumer can selectively move the drying rack 12 into the position that the consumer believes best accommodates the objects to be dried or suits the consumer's preference. It is understood that the drying rack 12 can have more or fewer partially folded positions.

Figure 2:
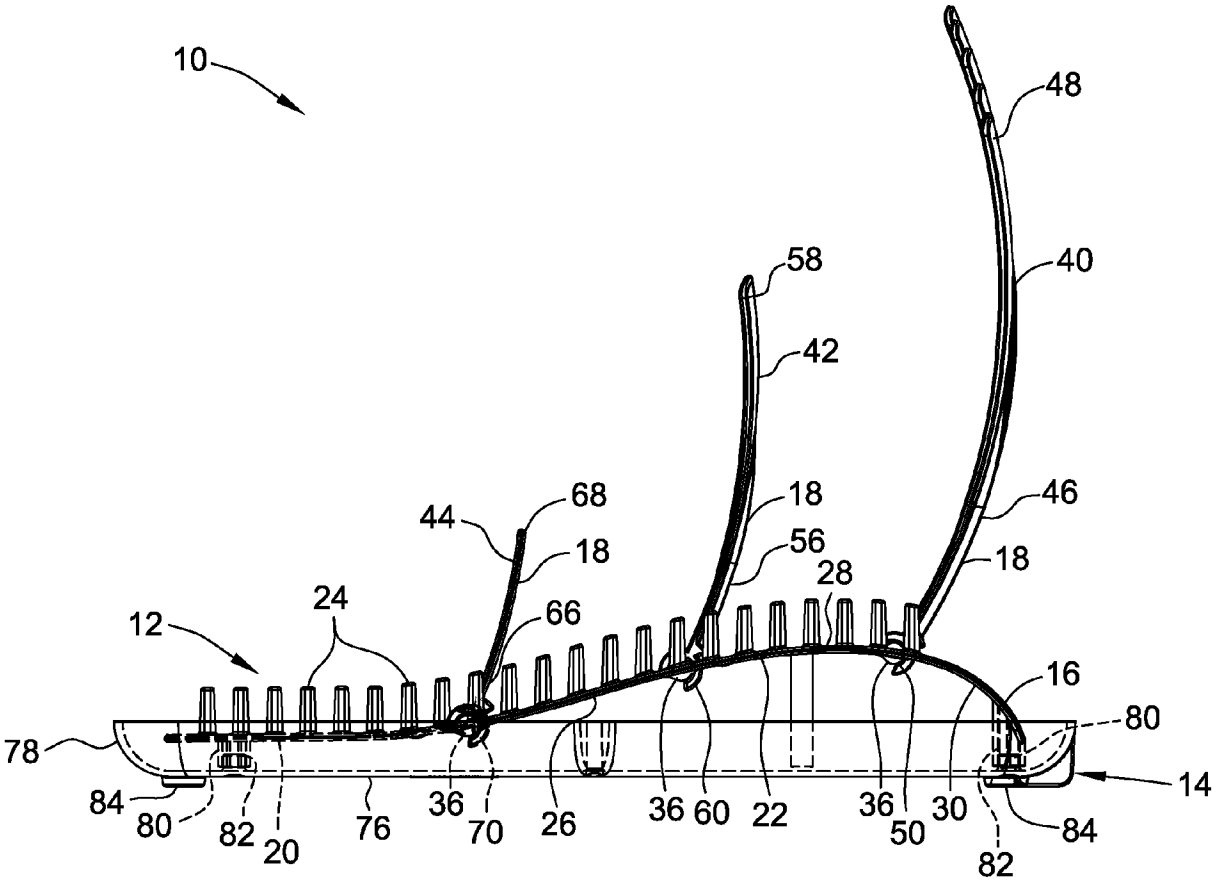
FIG. 2 is a side elevation of the drying rack assembly of FIG. 1.
Figure 5:
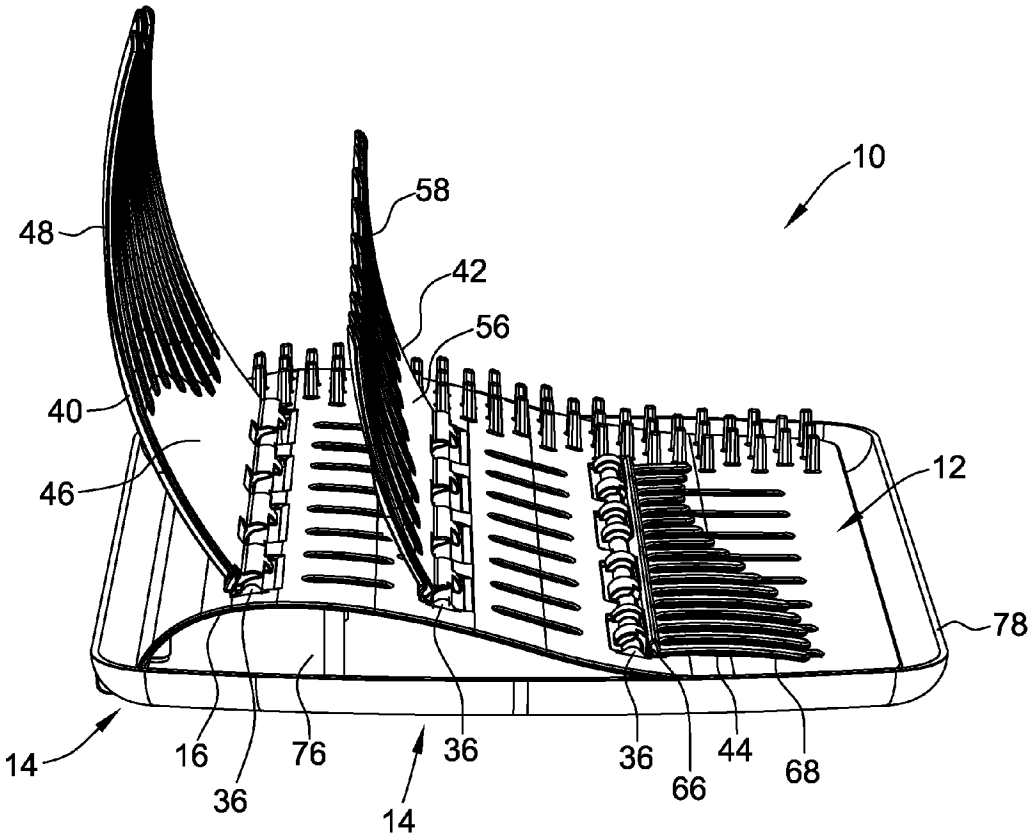
FIG. 5 is a side perspective of the drying rack assembly of FIG. 1 with a first, small panel shown in a collapsed position.

With reference now to FIGS. 1-5, the drying rack 12 includes a base, indicated generally at 16, and a plurality of panels, indicated generally at 18, pivotally attached to the base. As best illustrated in FIGS. 2 and 5, the base 16 has a generally flat portion 20, which lies generally in face-to-face relationship with the drip pan 14, and a curved portion 22, which rises in spaced relationship with the drip pan. While illustrated in the embodiment of FIGS. 1-7, the generally flat portion 20 of the base 16 may include a plurality of longitudinally, spaced apart ribs extending across all or part of the width of the base. A plurality of posts 24 also extend upward from the upper surface of the base generally along one side margin thereof (e.g., adjacent one end of the panels 18) from the flat portion 20 to the curved portion 22. It is understood that more or less posts 24 than those illustrated in the figures may extend up from the base 16. It is also contemplated that the posts 24 may extend upward from smaller areas of the upper surface of the base 16.

With reference still to FIGS. 2 and 5, the curved portion 22 of the base 16 includes an upwardly extending portion 26 that extends upward from the flat portion 20 to space the curved portion from the drip pan 14. The curved portion 22 further includes an apex 28 and a downwardly extending portion 30 that extends between the apex and the drip pan 14. In the illustrated embodiment, the upwardly extending portion 26 has a more gradual slope than the downwardly extending portion 30. That is, the downwardly extending portion 30 defines a greater incline as compared to the incline of the upwardly extending portion 26. It is understood, however, that the slopes of the upwardly and downwardly extending portions 26, 30 can be approximately the same or that the upwardly extending portion 26 can have a steeper slope than the downwardly extending portion 30.

Figure 3:
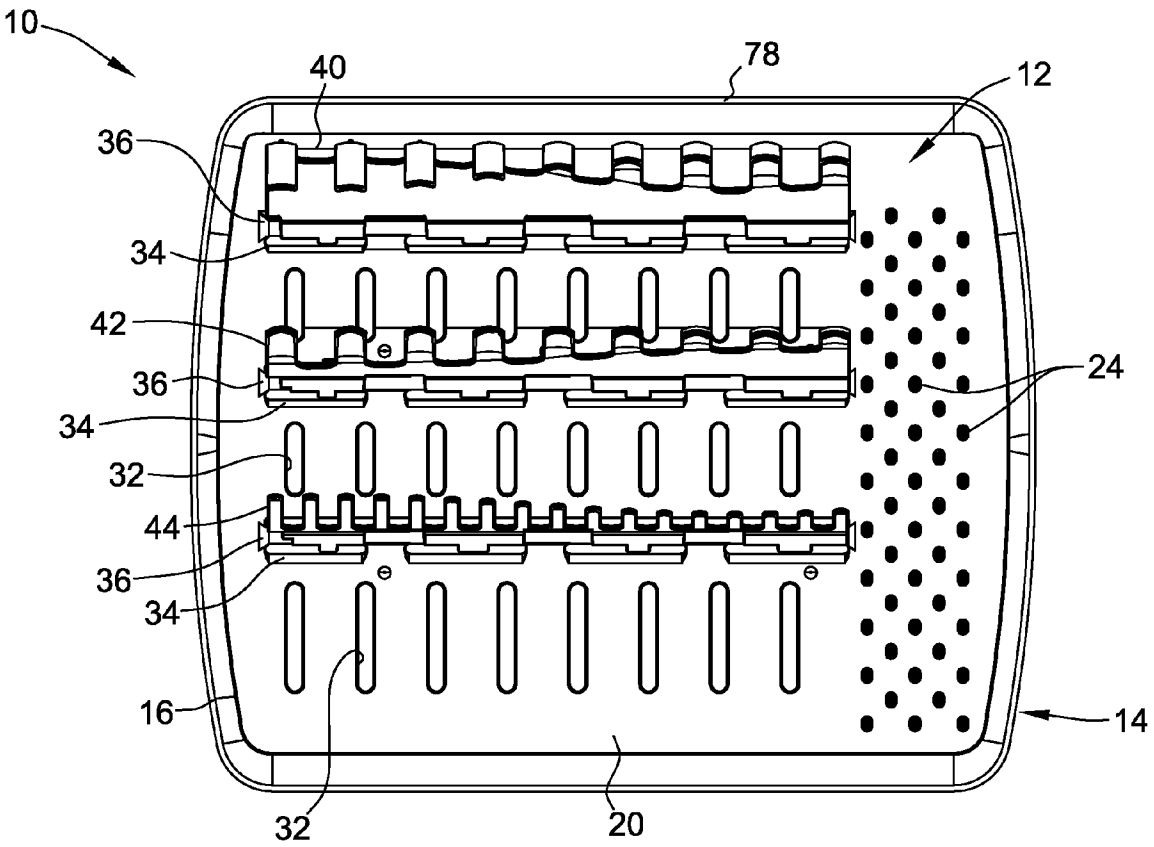
FIG. 3 is a to plan view of the drying rack assembly of FIG. 1.
Figure 4:
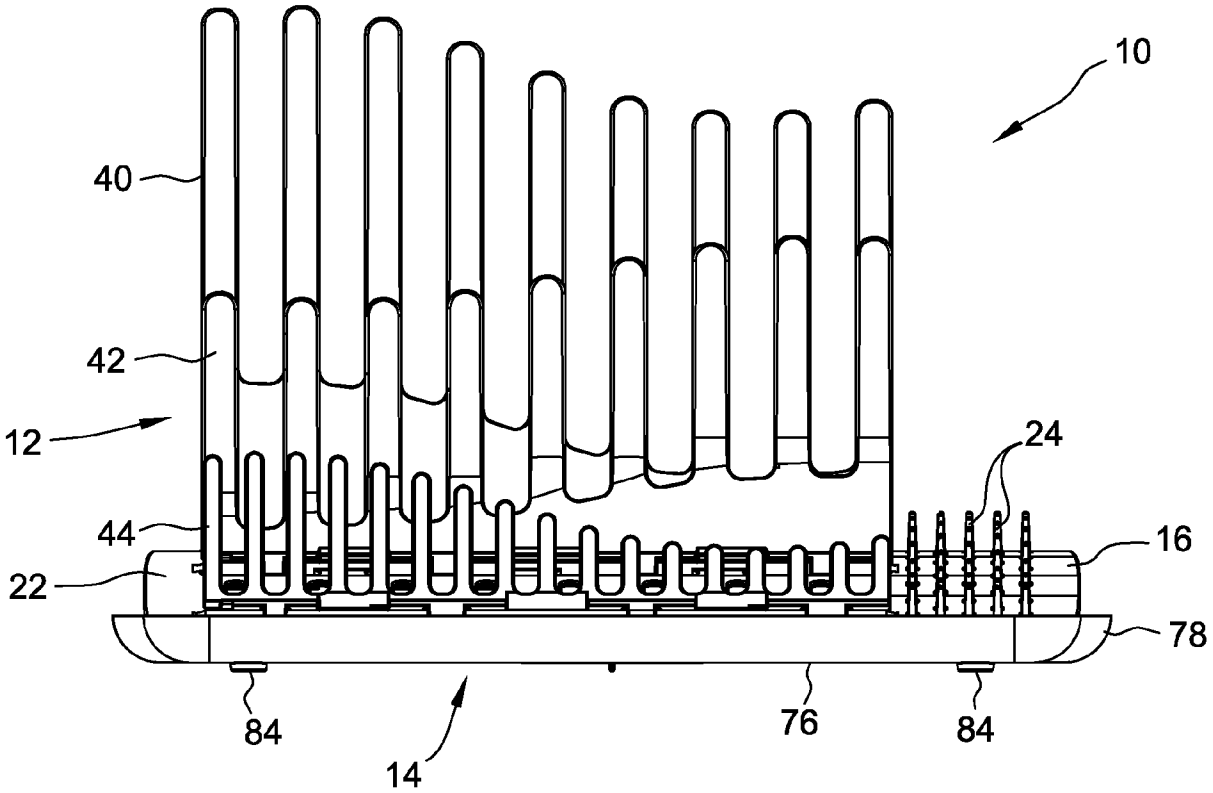
FIG. 4 is a front elevation of the drying rack assembly of FIG. 1.

As seen in FIGS. 1 and 3, for example, the base 16 of the drying rack 12 includes a plurality of openings 32 for allowing liquid to pass through the drying rack to the underlying drip pan 14. In the illustrated embodiment, each of the openings 32 is generally oval. It is understood, however, that the openings 32 can have any suitable shapes including, but not limited to, circular, rectangular, square, or combinations thereof It is also understood that the number of openings 32 and/or that the size of the openings 32 can be different than those seen in the accompanying figures. The openings 32 in the base 16 of the illustrated embodiment of the drying rack 12 are generally aligned in three longitudinally extending rows. See, e.g., FIG. 3. It is understood, however, that the openings 32 can have other suitable arrangements including being disposed on the base 16 in a generally random pattern.

The base 16 also includes a plurality of generally rectangular apertures 34 (FIGS. 1, 3 and 5). The apertures 34 in the base 16 are arranged to accommodate three longitudinally extending hinge pins 36 (one associated with each respective panel 18). Each of the illustrated hinge pins 36 is defined by four hinge pin segments, which extend through the respective aperture 34.

Figure 8:
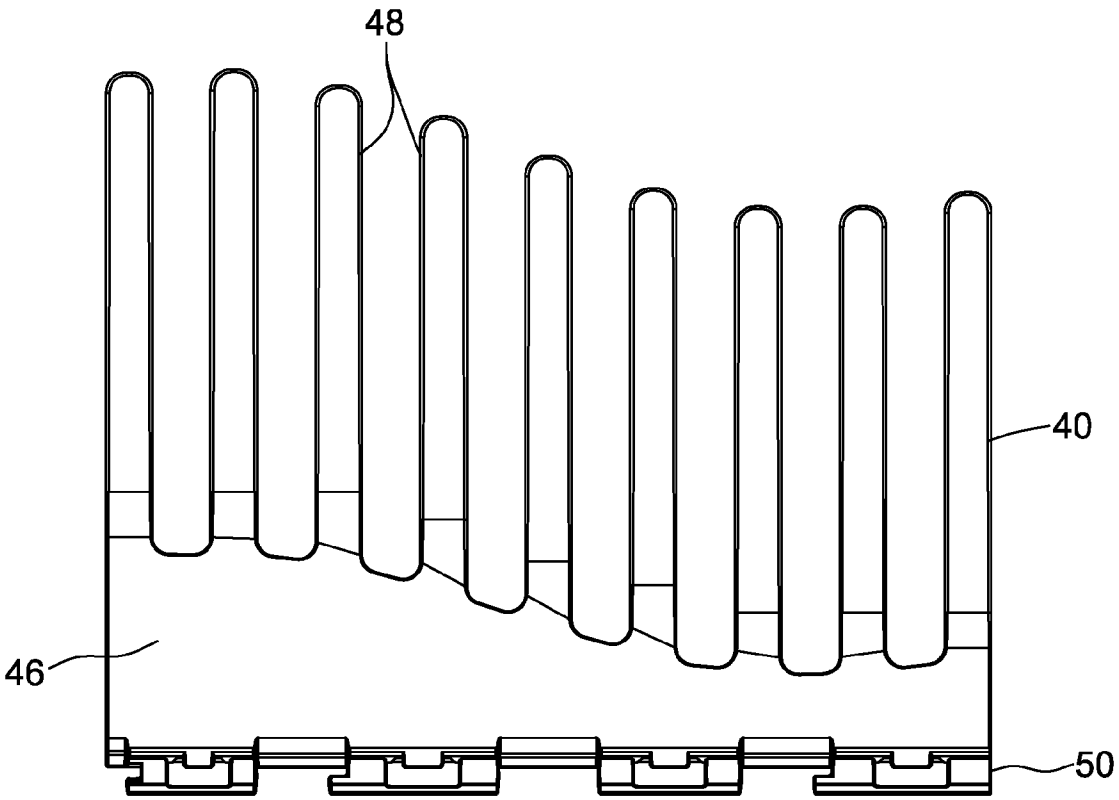
FIG. 8 is a front elevation of the large panel of the drying rack assembly of FIG. 1.
Figure 9:
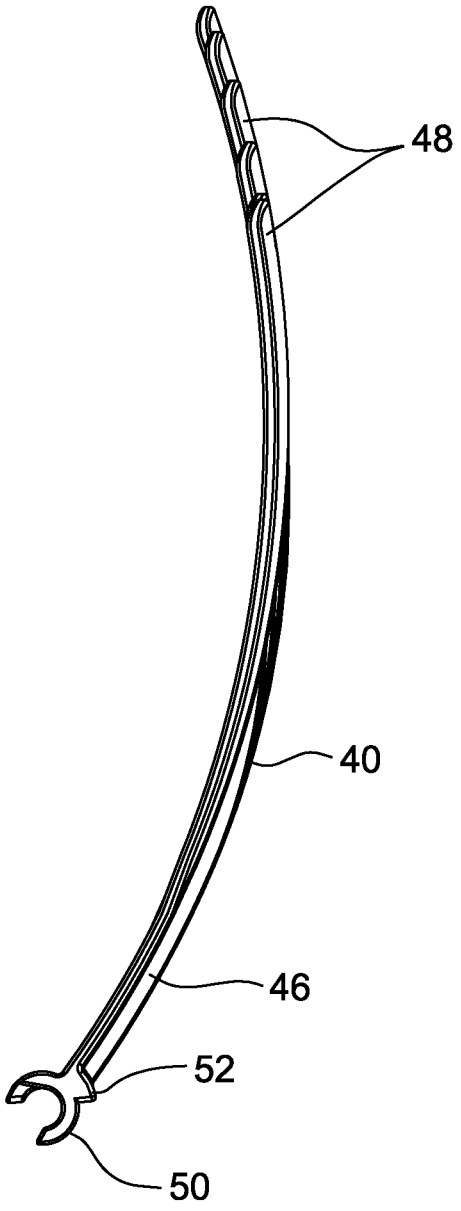
FIG. 9 is a side elevation thereof of the large panel.

The illustrated embodiment of the drying rack 12 has three panels 18 with each of the panels having a different size and shape. Specifically, the drying rack 12 comprises a first, larger panel 40, a second, medium panel 42, and a third, smaller panel 44. The larger panel 40, which is shown in FIGS. 8 and 9 separated from the drying rack 12, comprises a wall portion 46, a plurality of spaced-apart supports 48 extending upward from the wall portion, and a generally c-shaped attachment portion 50 formed at the bottom of the wall portion. In the illustrated embodiment, each of the supports 48 has approximately the same length. However, the top of the wall portion 46 from which the supports 48 extend is curved (i.e., generally sinusoidal). As a result, the tops of the supports 48 collectively define a sinusoidal pattern. As seen in FIG. 9, the wall portion 46 and the supports 48 of the panel 40 are arcuate. That is, the wall portion 46 and each of the supports 48 are curved along their lengths.

With reference still to FIGS. 8 and 9, the attachment portion 50 extends downward from the bottom of the wall portion 46. As mentioned above, the attachment portion 50 is generally c-shaped in cross-section and defines a longitudinally extending channel. The channel defined by the c-shape is sized and shaped to receive one of the hinge pins 36 formed in the base 16 of the drying rack 12. More specifically, the channel of the attachment portion 50 has a snap-fit connection with the hinge pin 36. In one suitable embodiment, the panel 40 can be selectively removed and replaced onto the base 16 via the snap-fit connection with the c-shaped attachment portion 50 and the hinge pin 36. It is understood, however, that the panel 40 can be attached to the base 16 in a non-removable manner.

Figure 7:
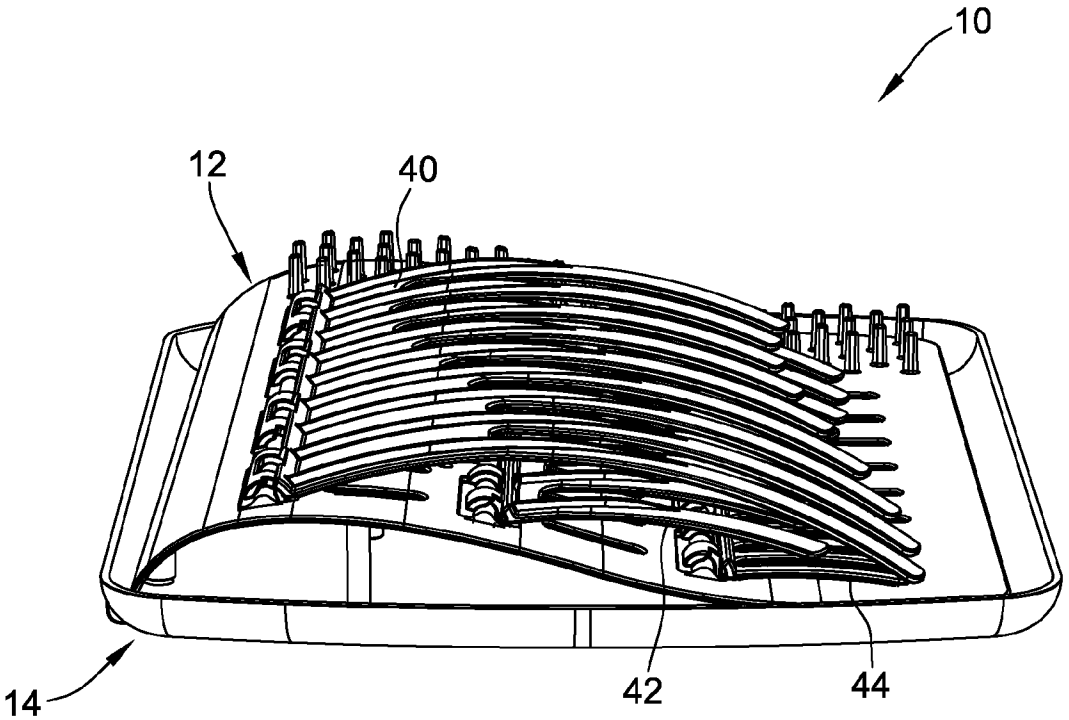
FIG. 7 is a side perspective similar to FIG. 6 with the small panel, medium panel and a third, large panel shown in a collapsed position.

With reference now to FIGS. 2 and 7, the panel 40 can be selectively pivoted about the hinge pin 36 between a standing position (FIG. 2, as well as FIGS. 5 and 5) and a collapsed position (FIG. 7). The attachment portion 50 includes a stop 52 for contacting the base 16 in the standing position of the panel to inhibit pivoting of the panel 40 beyond a predefined position (i.e., the standing position). In one embodiment, the larger panel 40 is pivotable about the hinge pin 36 from the collapsed position to the standing position through an angle a that is greater than 90 degrees until the stop 52 contacts the base 16 and thereby inhibits the panel from pivoting any further. It is understood, however, that the range of pivoting movement of the larger panel 40 may be less than or greater than 90 degrees and remain within the scope of this disclosure.

Figure 10:
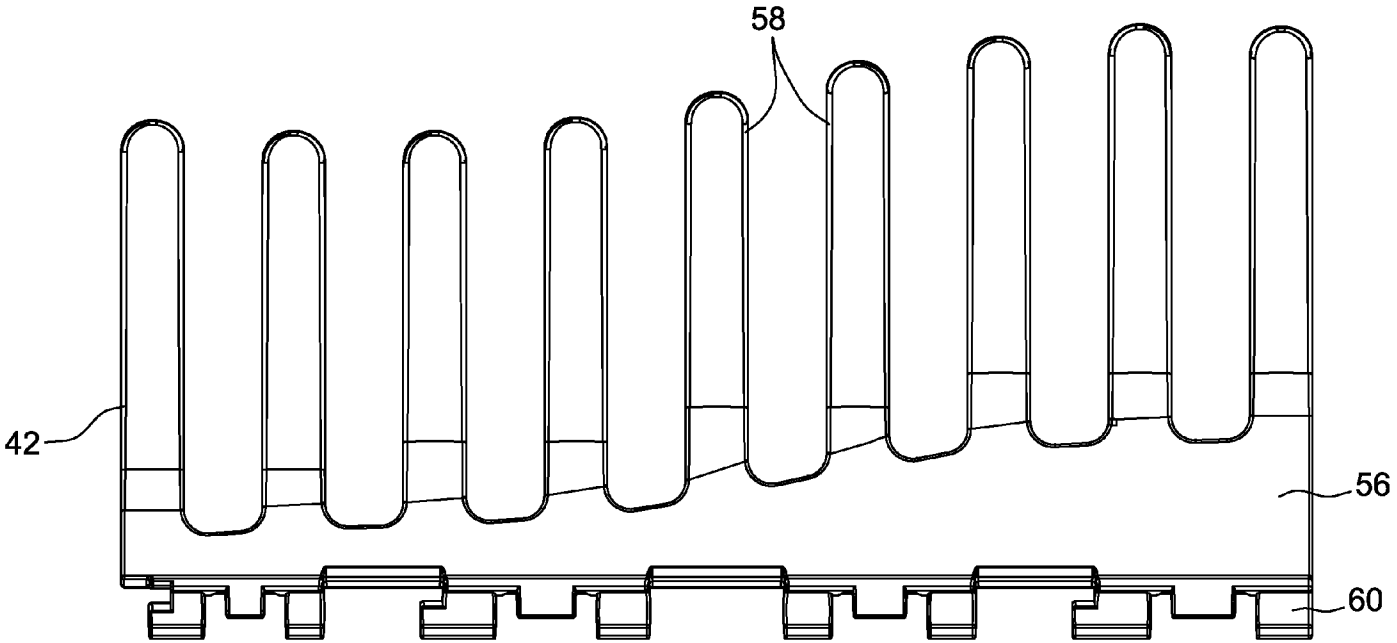
FIG. 10 is a front elevation of the medium panel of the drying rack assembly of FIG. 1.
Figure 11:
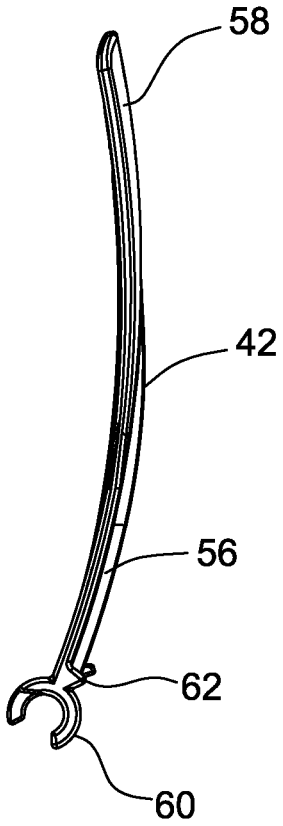
FIG. 11 is a side elevation thereof of the medium panel.

The middle panel 42, which is shown in FIGS. 10 and 11 separated from the drying rack 12, comprises a wall portion 56, a plurality of spaced-apart supports 58 extending upward from the wall portion, and a generally c-shaped attachment portion 60 formed at the bottom of the wall portion. In the illustrated embodiment, each of the supports 58 has approximately the same length. However, the top of the wall portion 56 from which the supports 58 extend is curved (i.e., generally sinusoidal). As a result, the tops of the supports 58 collectively define a sinusoidal pattern. As seen in FIG. 11, the wall portion 56 and the supports 58 of the panel 42 are arcuate. That is, the wall portion 56 and each of the supports 58 are curved along their lengths.

The attachment portion 60 extends downward from the bottom of the wall portion 56. As mentioned above, the attachment portion 60 is generally c-shaped in cross-section and defines a longitudinally extending channel. The channel defined by the c-shape is sized and shaped to receive one of the hinge pins 36 formed in the base 16 of the drying rack 12. More specifically, the channel of the attachment portion 60 has a snap-fit connection with the hinge pin 36. In one suitable embodiment, the panel 42 can be selectively removed and replaced onto the base 16 via the snap-fit connection with the c-shaped attachment portion 60 and the hinge pin 36. It is understood, however, that the panel 42 can be attached to the base 16 in a non-removable manner.

Figure 6:
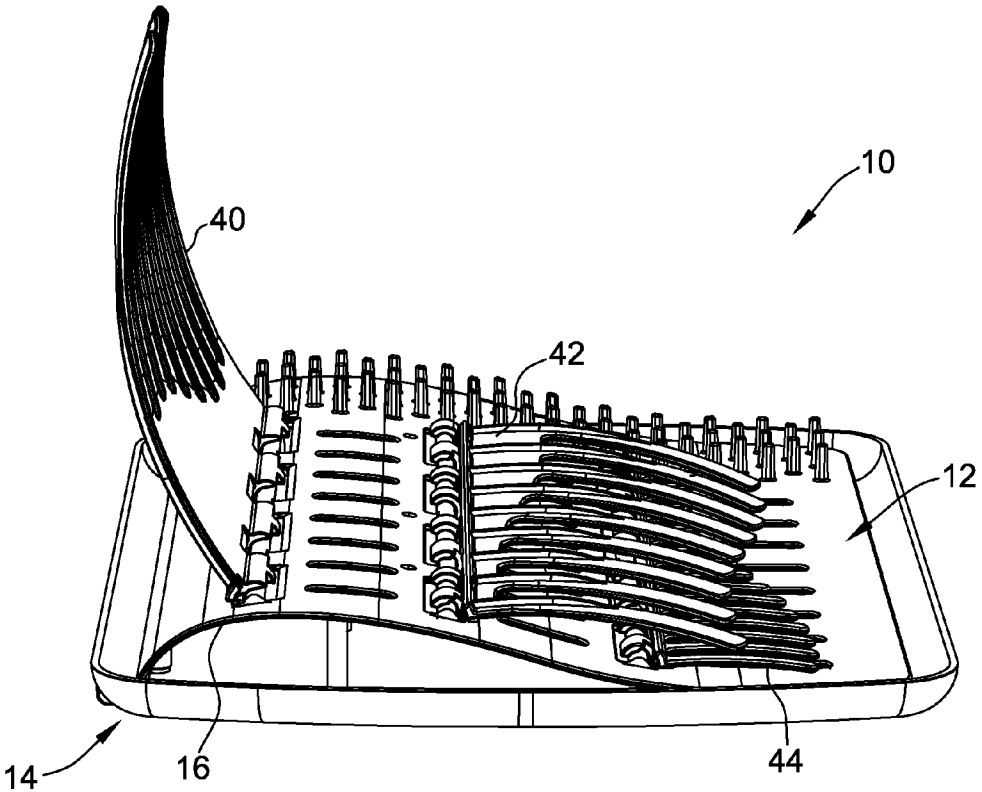
FIG. 6 is a side perspective similar to FIG. 5 with the small panel and a second, medium panel shown in a collapsed position.

With reference now to FIGS. 2 and 6, the panel 42 can be selectively pivoted about the hinge pin 36 between a standing position (FIG. 2) and a collapsed position (FIG. 6). The attachment portion 60 includes a stop 62 for contacting the base 16 in the standing position of the panel 42 to inhibit pivoting of the panel 42 beyond a predefined position (i.e., the standing position). In one embodiment, the middle panel 42 is pivotable about the hinge pin 36 from the collapsed position to the standing position through an angle $\alpha'$ that is greater than 90 degrees until the stop 62 contacts the base 16 and thereby inhibits the panel from pivoting any further. It is understood, however, that the range of pivoting movement of the middle panel 42 may be less than or greater than 90 degrees and remain within the scope of this disclosure.

Figure 12:
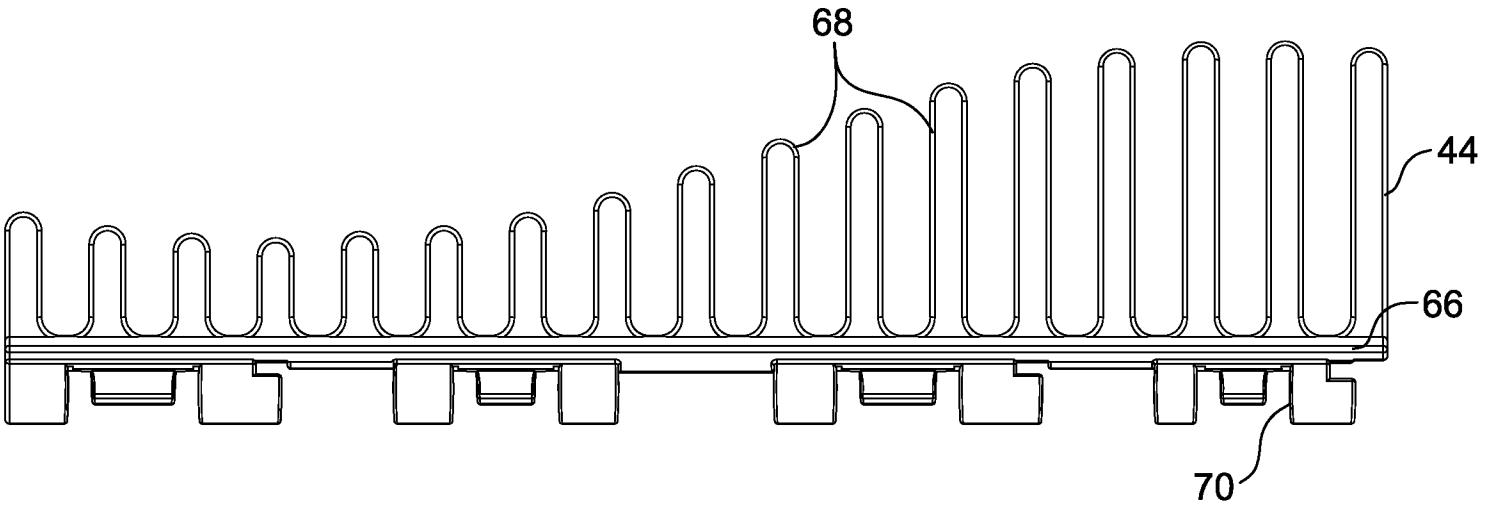
FIG. 12 is a front elevation of the small panel of the drying rack assembly of FIG. 1.
Figure 13:
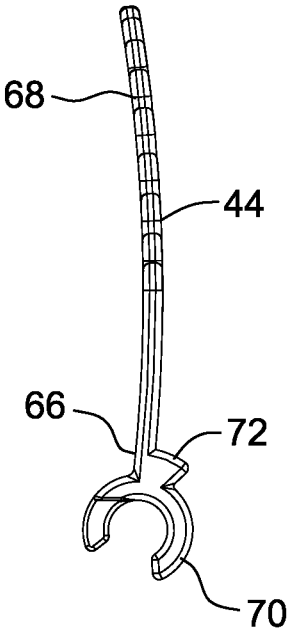
FIG. 13 is a side elevation thereof of the small panel.

The smaller panel 44, which is shown in FIGS. 12 and 13 separated from the drying rack 12, comprises a wall portion 66, a plurality of spaced-apart supports 68 extending upward from the wall portion, and a generally c-shaped attachment portion 70 formed at the bottom of the wall portion. In the illustrated embodiment, the supports 68 of the smaller panel 44 vary in length. As a result, the tops of the supports 68 collectively define a sinusoidal pattern. As seen in FIG. 13, the wall portion 66 and the supports 68 of the panel 44 are arcuate. That is, the wall portion 66 and each of the supports 68 are curved along their lengths. However, the curvature thereof is less than the curvature of the larger panel 40 and of the middle panel 42. In other embodiments, the curvature of the wall portion 66 and supports 68 of the smaller panel 44 may be equal to or greater than that of the larger panel 40 and/or the middle panel 42.

The attachment portion 70 extends downward from the bottom of the wall portion 66. As mentioned above, the attachment portion 70 is generally c-shaped in cross-section and defines a longitudinally extending channel. The channel defined by the c-shape is sized and shaped to receive one of the hinge pins 36 formed in the base 16 of the drying rack 12. More specifically, the channel of the attachment portion 70 has a snap-fit connection with the hinge pin 36. In one suitable embodiment, the panel 44 can be selectively removed and replaced onto the base 16 via the snap-fit connection with the c-shaped attachment portion 70 and the hinge pin 36. It is understood, however, that the panel 44 can be attached to the base 16 in a non-removable manner.

With reference now to FIGS. 2 and 5, the panel 44 can be selectively pivoted about the hinge pin 36 between a standing position (FIG. 2) and a collapsed position (FIG. 5). The attachment portion 70 includes a stop 72 for contacting the base 16 in the standing position of the panel 44 to inhibit pivoting of the panel 44 beyond a predefined position (i.e., the standing position). In one embodiment, the smaller panel 44 is pivotable about the hinge pin 36 from the collapsed position to the standing position through an angle $\alpha''$ that is greater than 90 degrees until the stop 72 contacts the base 16 and thereby inhibits the panel from pivoting any further. It is understood, however, that the range of pivoting movement of the smaller panel 44 may be less than or greater than 90 degrees and remain within the scope of this disclosure.

It is understood that the drying rack 12 can have more or fewer panels 40, 42, 44. It is also understood that one or more of the panels 40, 42, 44 can be segmented such that portions of the panel can be pivoted independently of the other portions. It is also contemplated that the panels 40, 42, 44 can have different shapes and configurations than those illustrated herein. It is further contemplated that each of the panels 40, 42, 44 can have the same shape and configuration.

The drying rack 12, in one suitable embodiment, is constructed of plastic, such as polypropylene, or other suitable material. The base 16 of the illustrated drying rack 12 and each of the panels 40, 42, 44 are suitably formed as single-piece components, such as by molding.

Figure 14:
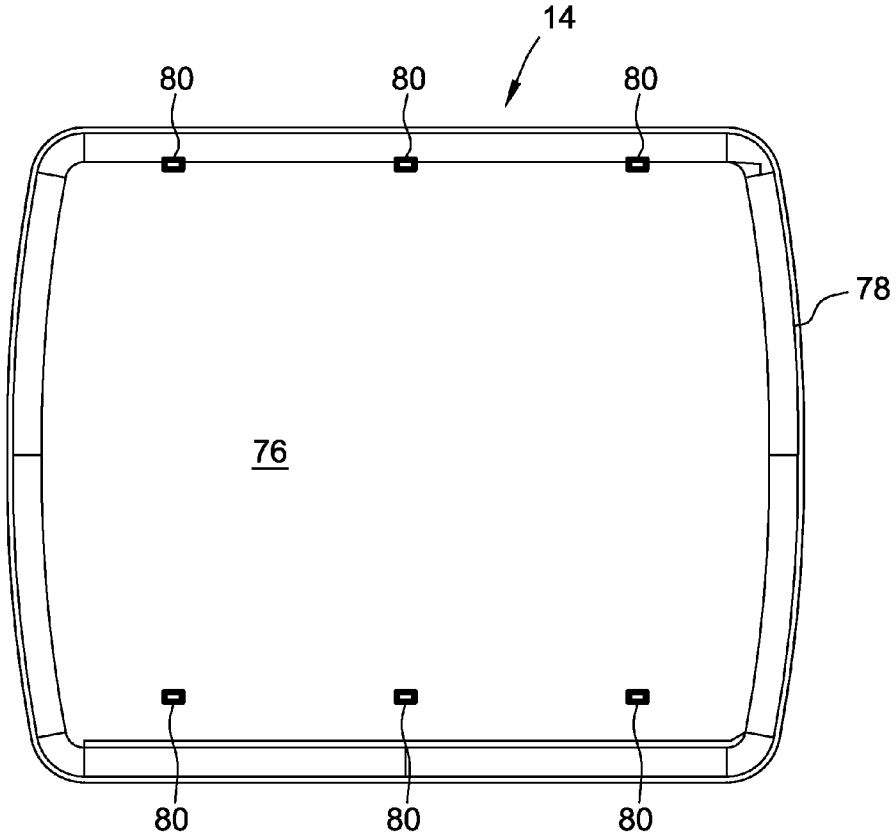
FIG. 14 is a top plan view of a drip pan of the drying rack assembly of FIG. 1.

With reference now to FIGS. 1, 2 and 14, the drip pan 14 of the drying rack assembly 10 is sized slightly larger (e.g., in length and width) than the drying rack 12 so that the entire drying rack can be received on the drip pan. The drip pan 14 comprises a non-porous, generally planar panel 76 and a peripheral wall 78 extending about and upward from the panel. As a result, during use the drying rack 12 can be placed on the panel 76 and within the peripheral wall 78 so that liquid runoff from the drying rack collects in the drip pan 14. It is understood that the drip pan 14 can have other suitable configurations. For example, the drip pan can be tilted, porous, or otherwise configured to facilitate drainage of liquid from the drip pan.

In the illustrated embodiment, the drying rack 12 and drip pan 14 have a snap-fit connection such that the drying rack and drip pan can be selectively attached and detached from one another. More specifically, the drip pan 14 comprises a plurality of sockets 80 (six being illustrated in FIG. 14) sized and shaped for selectively receiving corresponding posts (not shown) 82 (FIG. 2) formed on the drying rack. The socket 80 and post 82 engagement facilitates alignment (i.e., placement) of the drying rack 12 relative to the drip pan 14. It is contemplated that the drying rack 12 and drip pan 14 can be attached in a non-detachable manner. It is also contemplated that the drying rack 12 can rest on the drip pan 14 without being attached thereto. As illustrated in FIG. 2, the drip pan 14 includes a plurality of feet 84 for spacing the drying rack assembly 10 above a surface on which the assembly is placed. It is contemplated that the feet 84 can be omitted or have other configurations than those illustrated herein.

Figure 15:
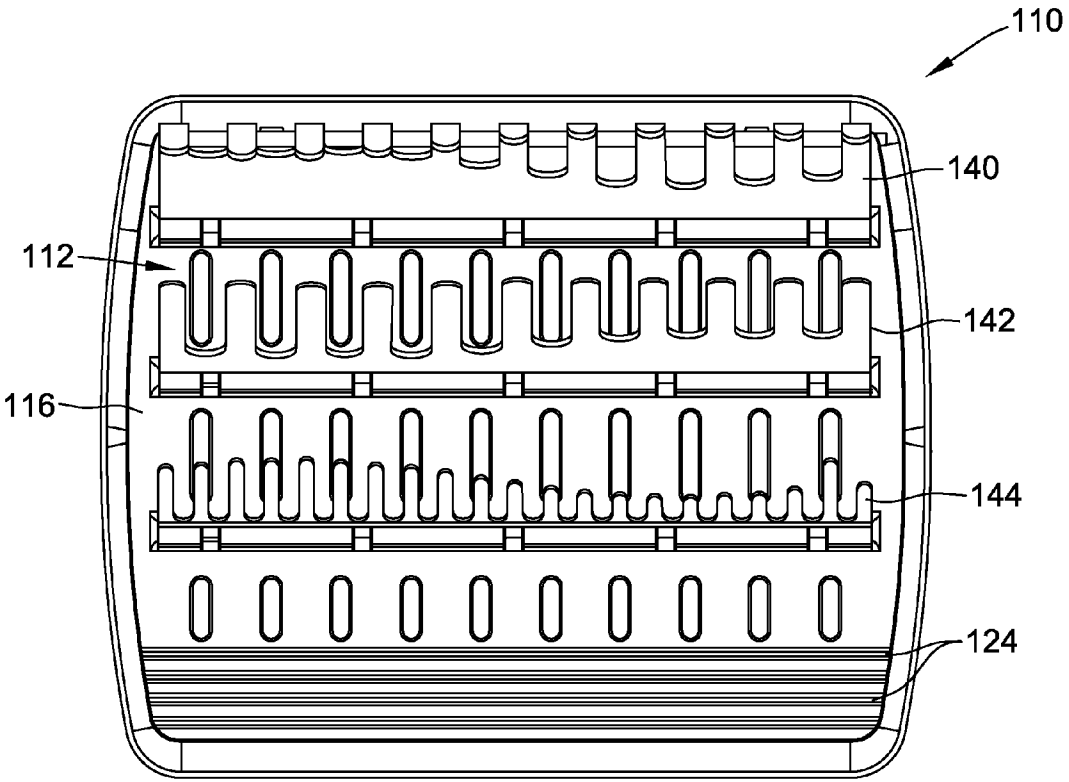
FIG. 15 is a top plan view of a second embodiment of a drying rack assembly of the present disclosure.
Figure 16:
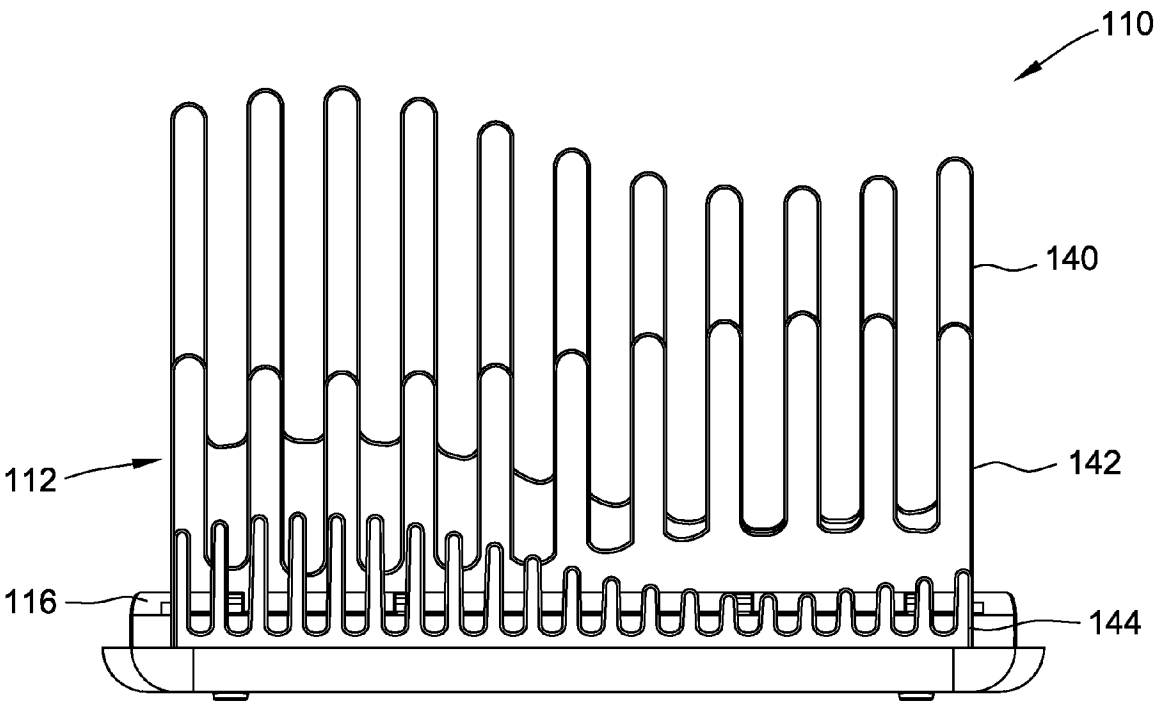
FIG. 16 is a front elevation thereof.

FIGS. 15 and 16 illustrate a second embodiment of a drying rack assembly 110 which is substantially similar to the drying rack assembly 10 of the embodiment of FIGS. 1-7, but in this second embodiment the upward extending posts 24 are omitted and instead each of the panels 140, 142, 144 extends across substantially the entire width of the base 116 of the drying rack 112. Additionally, four sets of elongate ribs 124 extending up from the base 116 of the drying rack 112 across substantially the entire width of the base to support objects above the base.

Figure 17:
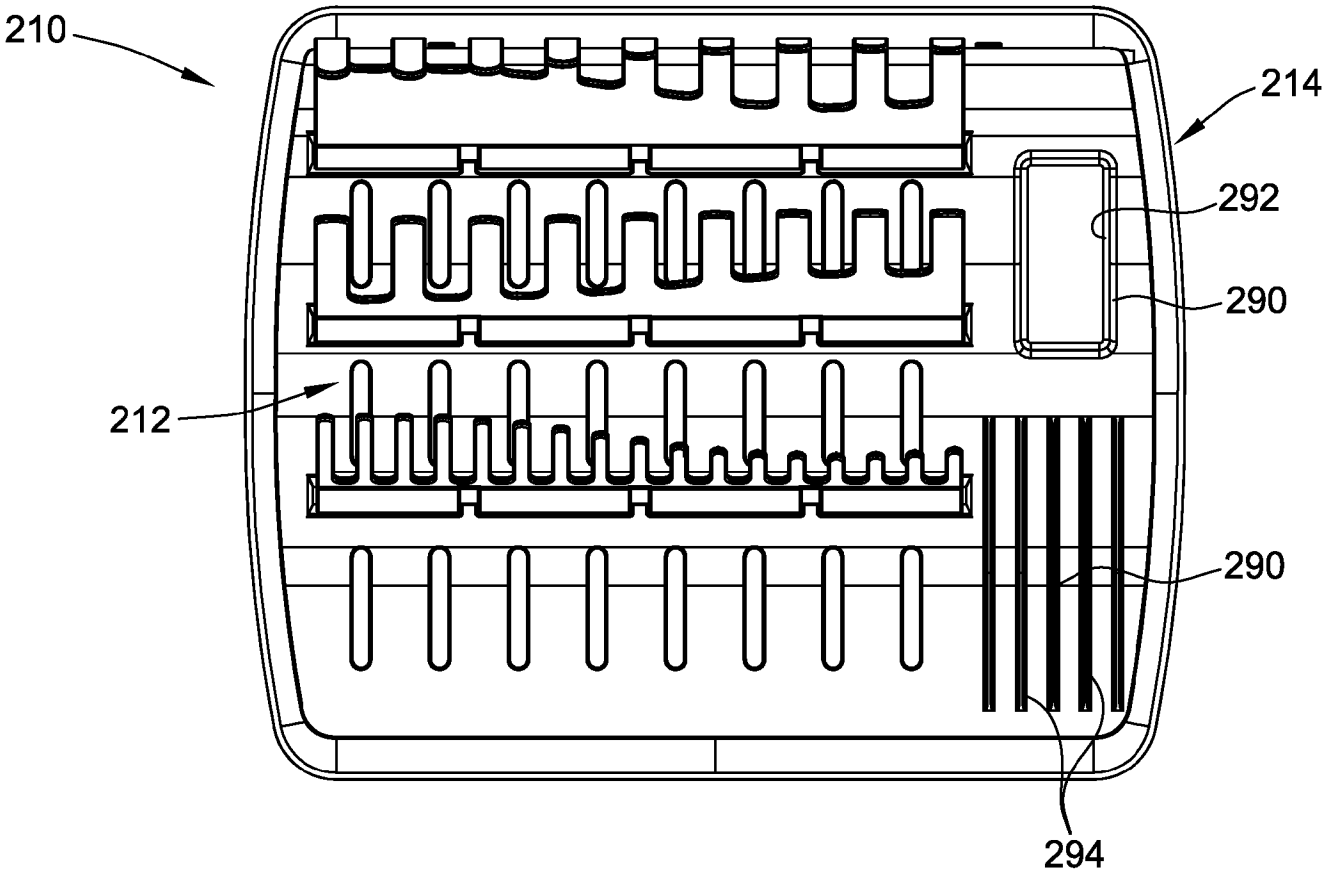
FIG. 17 is a top plan view of a third embodiment of a drying rack assembly of the present disclosure.
Figure 18:
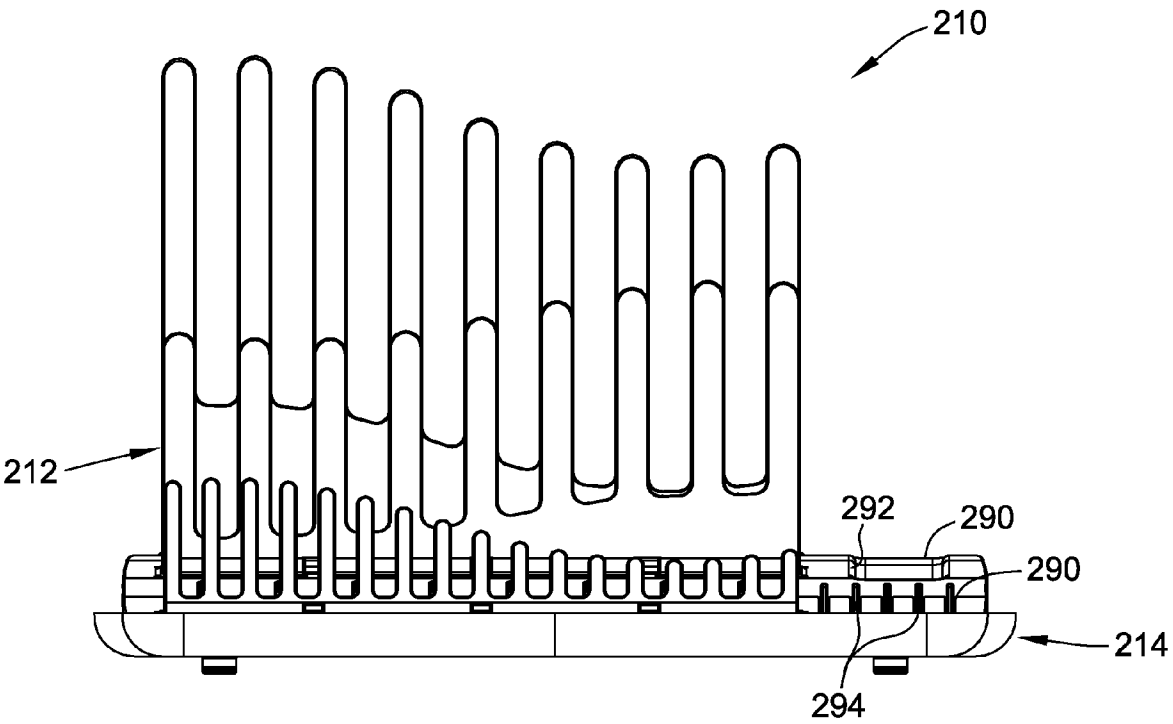
FIG. 18 is a front elevation thereof.

FIGS. 17 and 18 illustrate a third embodiment of a drying rack assembly 210 which is substantially similar to the drying rack assembly 10 of the embodiment of FIGS. 1-7, but in this third embodiment the drying rack 212 does not extend across the full width of the drip pan 214. Rather, a side margin of the drip pan 214 is uncovered by the drying rack 212 and includes two placement areas 290, for placing objects for drying. One of the illustrated placement areas 290 comprises a well 292 and the other placement area comprises a plurality of ribs 294 (five ribs being illustrated in FIG. 17). It is understood that the placement areas 290 can have different configurations than those illustrated herein. It is also understood that the drying rack assembly 210 can include more or fewer placement areas 290.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions and products without departing from the scope of the invention, it is intended that all matter contained in the above description and shown in the accompanying drawings and photographs shall be interpreted as illustrative and not in a limiting sense.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A drying rack assembly for countertop placement, the drying rack assembly being configured to hold one or more objects to be dried, the drying rack assembly comprising:

a drip pan;

a drying rack positionable on the drip pan for holding said one or more objects to be dried above the drip pan, the drying rack comprising a base seatable on the drip pan, at least a portion of the base being configured for disposition above the drip pan upon seating the drying rack on the drip pan, and at least one panel pivotably connected to the base for positioning relative to the base between a standing position for supporting said one or more objects to be dried and a collapsed position in which the at least one panel is generally laid down against the base, the at least one panel comprising a plurality of upstanding supports disposed in spaced relationship with each other, at least one of the upstanding supports being arcuate along its length, at least two of the upstanding supports extending to different heights above the base in the standing position of the at least one panel.

2. The drying rack assembly of claim 1 wherein the at least one panel comprises a first panel pivotably connected to the base for positioning relative to the base between the standing position and the collapsed position, and a second panel spaced from the first panel and being pivotably connected to the base for positioning relative to the base between a standing position for supporting said one or more objects to be dried and a collapsed position in which the second panel is generally laid down against the base.

3. The drying rack assembly of claim 2 wherein the second panel is generally parallel to and spaced from the first panel.

4. The drying rack assembly of claim 3 wherein the first panel is positionable between its respective standing position and its respective collapsed position when the second panel is in its respective collapsed position.

5. The drying rack assembly of claim 1 wherein the drying rack is removable from the dip pan.

6. The drying rack assembly of claim 1 wherein the base of the drying rack has at least one opening therein through which water from the one or more objects being dried can drain down through the base onto the drip pan.

7. The drying rack assembly of claim 1 wherein the base of the drying rack has a generally flat portion generally parallel to the drip pan in closely spaced relationship therewith and a generally arcuate portion connected to the flat portion and arching above the drip pan.

8. The drying rack assembly of claim 7 wherein the at least one panel is connected to the generally arcuate portion of the base.

9. The drying rack assembly of claim 1 wherein the at least one panel includes a stop configured to contact the base in the standing position of the at least one panel to inhibit pivoting of the at least one panel other than toward the collapsed configuration thereof.

10. The drying rack assembly of claim 2 wherein in the standing positions of the first and second panels, the first panel has a first height and the second panel has a second height greater than the first height of the first panel.

11. A drying rack assembly for countertop placement, the drying rack assembly being configured to hold one or more objects to be dried, the drying rack assembly comprising:

a drying rack, the drying rack comprising a base having a front end and a rear end, the base being arched along at least a portion thereof intermediate the front end and rear end to define a first portion disposed at a first height and a second portion disposed at a second height greater than the first height, the second portion comprising the portion of the base being arched, a first panel pivotably connected to the base at the first portion for positioning relative to the base between a standing position for supporting said one or more objects to be dried and a collapsed position in which the first panel is generally laid down against the base, and a second panel connected to the base at the second portion on the portion of the base being arched for positioning relative to the base between a standing position for supporting said one or more objects to be dried and a collapsed position in which the second panel is generally laid down against the base.

12. The drying rack assembly of claim 11 wherein the first portion of the base is generally flat.

13. The drying rack assembly of claim 11 wherein the second panel is generally parallel to and spaced from the first panel.

14. The drying rack assembly of claim 13 wherein the second panel is positionable between its respective standing position and its respective collapsed position when the first panel is in its respective collapsed position.

15. The drying rack assembly of claim 11 wherein the base of the drying rack has at least one opening therein through which water from the one or more objects being dried can drain down through the base.

16. The drying rack assembly of claim 11 wherein the first panel includes a stop configured to contact the base in the standing position of the first panel to inhibit pivoting of the first panel other than toward the collapsed configuration thereof, the second panel including a stop configured to contact the base in the standing position of the second panel to inhibit pivoting of the second panel other than toward the collapsed configuration thereof.

17. The drying rack assembly of claim 11 wherein the first panel comprises a plurality of upstanding supports disposed in spaced relationship with each other, at least one of the upstanding supports of the first panel being arcuate along its length, the second panel comprising a plurality of upstanding supports disposed in spaced relationship with each other, at least one of the upstanding supports of the second panel being arcuate along its length.

18. The drying rack assembly of claim 11 wherein in the standing positions of the first and second panels, the first panel has a first height above the base and the second panel has a second height above the base greater than the first height of the first panel above the base.

* * * * *